United States Patent [19]

Gamberg

[11] 4,023,728

[45] May 17, 1977

[54] COIN SLOT FOR FLIP TOP CAN

[76] Inventor: William Gamberg, 5506 Dent Ave., San Jose, Calif. 95118

[22] Filed: Jan. 22, 1976

[21] Appl. No.: 651,552

[52] U.S. Cl. ..... 232/4 R; 46/2; 222/570; 232/44

[51] Int. Cl.[2] ..... A47G 29/00

[58] Field of Search ..... 46/2; 232/44, 55, 4 R; 222/569, 570, 81, 90

[56] References Cited

UNITED STATES PATENTS

| | | | |
|---|---|---|---|
| 269,673 | 12/1882 | Hotchkiss | 232/44 |
| 863,603 | 8/1907 | Headley | 232/44 |
| 1,465,793 | 8/1923 | Schilling | 222/90 |
| 1,570,572 | 1/1926 | Lowenstein | 232/4 R |
| 2,158,502 | 5/1939 | Harrison | 222/90 |
| 2,218,431 | 10/1940 | McGee | 46/2 |
| 2,312,351 | 3/1943 | McCarthy | 222/90 |
| 2,587,716 | 3/1952 | Fengler | 222/90 |
| 3,088,631 | 5/1963 | Lien et al. | 222/570 X |
| 3,197,089 | 7/1965 | Michael | 222/570 X |
| 3,262,612 | 7/1966 | Tabor | 222/570 X |

*Primary Examiner*—F. Barry Shay
*Attorney, Agent, or Firm*—Leslie M. Hansen

[57] ABSTRACT

This is a coin slot adapted to be applied to a flip-top type of can after its pull-out tab has been removed leaving a tear drop shaped opening in the top of the can. The coin slot is formed with a cap member dimensioned to cover the opening and extend diametrically across the top of the can and provided with a wedge-shaped extension partially insertable into the opening in the can top provided with a fulcrum groove engaging the can top adjacent the rim of the can such that a lever action is afforded to the cap member upon depressing the latter onto the can top while fracturing part of the can top bordering the opening therein and effecting a locking action between such fractured parts and grooved sides in the wedge-shaped extension.

4 Claims, 11 Drawing Figures

FIG. 1.
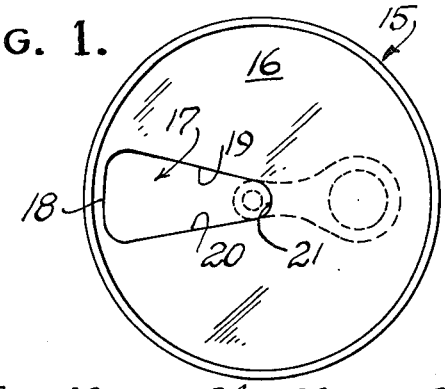
FIG. 2.
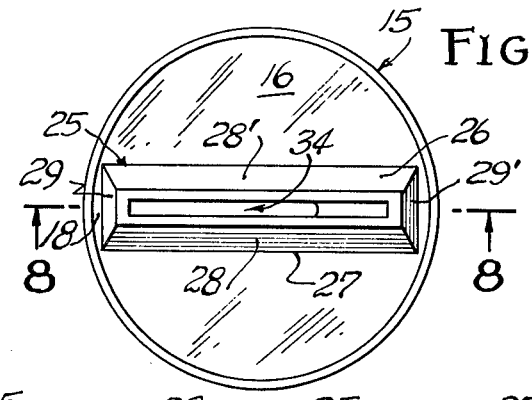
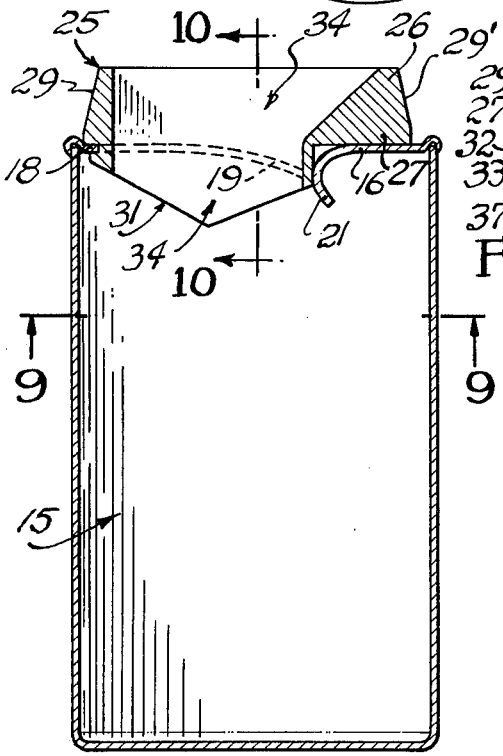
FIG. 8.
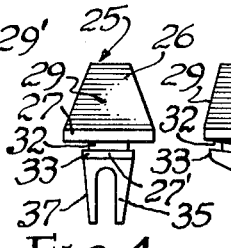
FIG. 4.
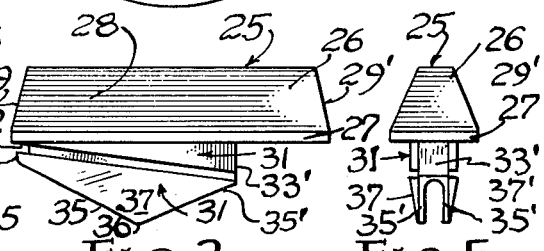
FIG. 3.
FIG. 5.
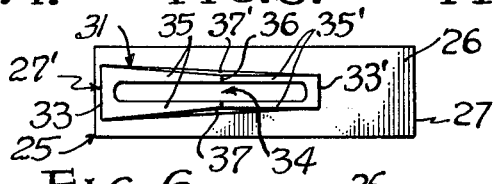
FIG. 6.
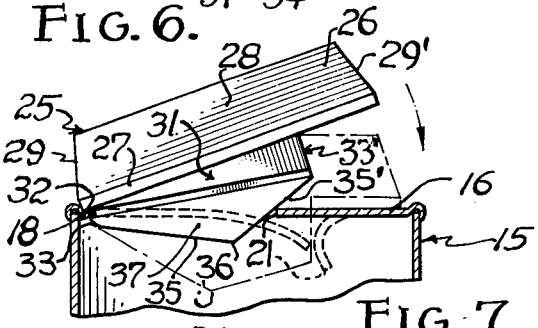
FIG. 7.
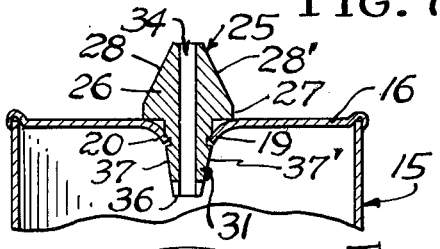
FIG. 10.
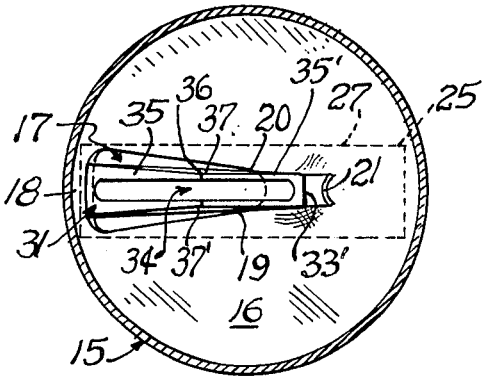
FIG. 9.
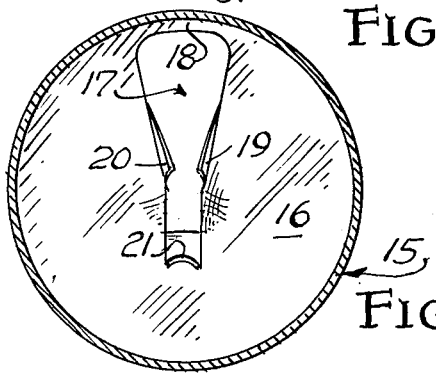
FIG. 11.

COIN SLOT FOR FLIP TOP CAN

This invention relates to a coin slot adapted to be applied to an empty can and more particularly to a coin slot applicable to a flip top type of can.

BACKGROUND

Many can companies have made cans with an open coin slot formed in the top of a can. Such coin receiving cans are usually provided for charitable institutions as coin collectors for fund drives and such.

Banking and savings and loan institutions have also provided coin bank applicators for use on cans having a common coin slot formed in their tops. U.S. Pat. No. 2,218,431, which issued to McGee on Oct. 15, 1940, shows one example of an applicator provided to encourage the saving of coins in a conventional tin can.

With the advent of flip top cans, no known form of applicative coin slot therefor exists. The present invention is directed to a coin slot constructed for insertion into the opening in a can top remaining after removal of the tear-out type tab provided in flip-top cans.

THE PRESENT INVENTION

This invention has as its principle object the provision of a coin slot constructed for press fit into the opening in the top of a flip-top can and adapted to effect a shearing action to the can top during seating of the coin slot in position thereon. It is another object of the coin slot embodiment of the present invention to provide the latter with means for engaging the fractured part of the can top for preventing removal of the coin slot therefrom, once it is properly applied thereto.

It is yet another object to provide such a coin slot with an exposed cap structure adapted to cover the entire opening in the top of a flip top can.

It is still another object to provide a wedge-shaped extension on the lower surface of the coin slot of the present invention of reduced dimension with respect to the cap thereof for partial insertion into the opening in the top of a flip top can. In this connection, the wedge-shaped extension is provided with a grooved edge at one end engageable by the top of the can adjacent an edge bead thereof to effect a fulcrum end lever action to the coin slot upon depression of the latter into seated relation upon the top of the can.

In conjunction with the foregoing object, the wedge-shaped extension is provided with side grooves into which fractured parts of the can top are adapted to flex and form a lock between the can top and can slot.

These and other objects of the present invention will become apparent from a reading of the following description and claims in the light of the accompanying single sheet of drawing in which:

FIG. 1 is a top plan view of a flip top can having the precreased cover removed to provide an opening therein;

FIG. 2 is a view of FIG. 1 with the coin slot of the present invention applied to the opening therein;

FIG. 3 is a side elevation of the coin slot only of FIG. 2;

FIG. 4 is an end view of FIG. 3 seen from the lefthand end thereof;

FIG. 5 is an end view of FIG. 3 as seen from the right-hand end thereof;

FIG. 6 is a bottom plan of FIG. 3;

FIG. 7 is a fragmentary section through the can top of FIG. 1 with the coin slot of FIG. 3 positioned for application thereto;

FIG. 8 is a cross section of FIG. 2 taken along line 8—8 therein showing the coin slot fully seated on the can top;

FIG. 9 is a horizontal section through FIG. 8 looking upwardly toward the top with coin slot applied thereto;

FIG. 10 is a fragmentary cross section through the coin slot and can top of FIG. 8 taken along line 10—10 therein; and FIG. 11 is a horizontal section through the can as seen looking up into FIG. 10 with the coin slot removed to illustrate the fracture of the can top as formed by the coin slot when it was applied from full to dotted lines in FIG. 7 and as shown in FIGS. 8 and 9.

GENERAL DESCRIPTION

Referring to FIG. 1 in the drawing, a flip-top can designated 15 is shown to have the usual precreased pull tab cover removed from its top 16 leaving an opening 17 formed therein. Such opening 17 is usually formed like a tear drop having its widest dimension at an edge 18 adjacent the rim of the cam and narrowing along radial edges 19 and 20 toward a smaller end 21 adjacent the center of the can top 16.

DETAILED DESCRIPTION OF THE INVENTION

The coin slot having the embodiment of the present invention has a body generally designated 25 in the drawing. The coin slot body 25 includes a cap member 26 having a base 27 of a length substantially that of the diameter of the can top 16 and of a width sufficient to cover the broadest dimension of the opening 17 in the can top. The cap member 26 has beveled side walls 28–28′ and beveled end walls 29–29′ terminating in an upper surface 30 at a level approximately of a heighth from the base 27 comparable to the width of the base.

The coin slot body 25 also has a wedge-shaped extension 31 projecting downwardly from its base 27. The extension 31 has an end wall 27′ inset slightly from that end of the base 27 from which the beveled end wall 29 extends upwardly. At this end 27′, the extension is provided with a groove 32 formed between the base 27 and a bead 33 at inset wall 27′. The groove 32 continues along each side of the extension 31 in a downward direction to the terminal end 33′. The extension 31 is of a length sufficient to allow for the provision of a passage 34 for a coin having the diameter of a Silver Dollar. The side walls of the extension 31 are spaced such that the passage 34 shall have a width sufficient to pass a coin having a thickness of a Silver Dollar. As best seen in FIG. 6, the terminal end 33′ of the extension 31 is narrower than that end 27′ thereof adjacent the end wall 29 of the cap 26. Thus it will be noted that the side walls of the extension 31 taper from the end wall 27′ toward the terminal end 33′.

The lower edge of the extension 31 is divided into two diagonally disposed or angular faces 35 and 35′ which merge at an apex 36 at the extreme lower edge of the extension 31. From the apex 36 to the narrower terminal end 33′, the angular face 35′ remains the same width as the latter. The side edges of the angular face 35 extend from the narrow apex to the widest end 27′ of the extension 31. By this arrangement, the extension 31 is provided tapered triangular sides 37–37′ below the downwardly tending grooves on each side of the extension 31. This provides the coin slot body 25 with a wedge-shaped extension 31 adapted to be initially inserted into the opening 17 of a flip top can. First the groove 32 at end 27' of the extension 31 is set to receive the edge 18 of the can top at the widest end of the opening 17 as shown in FIG. 7. The narrowest bottom face 35' is thus resting against the edges 19 and 20 as well as the smallest end 21 of the opening 17 adjacent the center of the can. The entire can slot body 25 is thus at rest in an angular disposition relative to the can top 16. The cap member 26 thus acts as a level having a fulcrum where the edge 18 of the can top engages in the groove 32 of the lower extension 31.

Referring again to FIG. 7, downward pressure of the raised end 29' of the cap member 26 from full to dotted lines (clockwise as indicated by the arrow *a* ) seats the can slot body upon the can top 16. During the lever action above explained, the wedge-shaped extension 31 effects a shearing action against the edges 19 and 20 of the can top flexing them inwardly of the can. The inwardly flexed portion of the edges 19 and 20 being slightly resilient, then engages the grooves along each side of the extension 31 to lock the latter in place as shown in FIG. 10. At the final leveling of the base 27 against the can top, the terminal end 33' of the wedge-shaped extension 31 shears a part of the edge 21 of the can top from the center of the can and curls such sheared part downwardly into the can as shown in FIG. 8.

The entire can slot body 25 is thus secured to the can top 16 with the base 27 of the cap member 26 resting face to face upon the can top. The coin passage 34 previously mentioned extends upwardly through the cap member 26 and flares outwardly toward the end wall 29' on the cap member from the terminal end 33'. The beveled side walls 28 and 28' on the cap member 26 provide suitable surfaces for advertising matter or slogans and the like. Should the can slot body 25 ever be removed from a can top to empty out the coins, it may again be used on another flip top type of can.

Having thus described the can top can slot embodiment of the present invention in specific detail, it will be appreciated that it may be susceptible to alternations, variations and/or modifications without departing from the spirit or scope of the invention therein as called for in the appended claims.

What I claim as new and desire to protect by Letters Patent is:

1. A coin slot and a flip-top can having an opening formed in its top, said opening having its widest dimension at a lip edge of the can top adjacent the rim bead of such can and side edges extending toward a reduced terminal edge adjacent the center of the can top; said coin slot comprising a coin slot body including:

1. a cap member having a base of a length comparable to the diameter of the can top and a width sufficient to cover the widest dimension of the opening formed therein, said cap member having a coin slot formed lengthwise thereof from its top to the bottom of its base;
2. a wedge-shaped extension extending downwardly from the base of said cap member of a width and length sufficient to form a border around a passage sufficient to pass the largest coin therethrough, and having such a passage in communication with the coin slot formed through said cap member;
3. said extension having one end thereof inset slightly from one end of said cap member and provided with a bead spaced from the lower surface of said base to form a fulcrum groove for receiving the lip edge of the opening in the can top, to provide for fulcrumed lever action by said cap member upon manual depression of the latter toward the can top, and said extension including means for fracturing the terminal edge of said opening upon said manual depression of said cap member.

2. The coin slot body in accordance with claim 1 in which said wedge-shaped extension has means including inwardly tapering sides of said extension disposed in the opening in the can top and engageable by the side edges of the opening for fracturing the latter upon manual depression of the cap member toward the can top.

3. The can slot body in accordance with claim 2 in which said wedge-shaped extension has a groove on each side thereof for receiving the fractured side edges of said can top for locking the coin slot body thereto.

4. The coin slot body in accordance with claim 3 in which that end of said wedge-shaped extension opposite the groove end thereof is engageable with the edge of the can top bordering the reduced terminal edge of the opening therein for fracturing said terminal edge and curling the latter into the can.

* * * * *